US009976524B2

(12) United States Patent
Takaoka et al.

(10) Patent No.: US 9,976,524 B2
(45) Date of Patent: May 22, 2018

(54) DIESEL WORK VEHICLE WITH DUEL FUEL TANKS

(71) Applicant: KUBOTA CORPORATION, Osaka, Osaka (JP)

(72) Inventors: Masaki Takaoka, Osaka (JP); Seiya Yoshida, Osaka (JP); Junki Nakao, Osaka (JP); Hideki Aoki, Osaka (JP); Osami Fujiwara, Osaka (JP); Hiroyuki Tada, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 86 days.

(21) Appl. No.: 14/659,953

(22) Filed: Mar. 17, 2015

(65) Prior Publication Data

US 2016/0069309 A1 Mar. 10, 2016

(30) Foreign Application Priority Data

Sep. 9, 2014 (JP) ..... 2014-183279

(51) Int. Cl.
*F02M 37/00* (2006.01)

(52) U.S. Cl.
CPC .... *F02M 37/0088* (2013.01); *F02M 37/0023* (2013.01); *F02M 37/0029* (2013.01); *F02M 37/0047* (2013.01); *F02M 37/0052* (2013.01)

(58) Field of Classification Search
CPC ..... F02M 37/0088; F02M 37/0023; F02M 37/0052; F02M 37/0047; F02M 37/0029
See application file for complete search history.

(56) References Cited

U.S. PATENT DOCUMENTS 5,168,891 A * 12/1992 Green ..... B60K 15/077 137/114
6,276,342 B1 * 8/2001 Sinz ..... B60K 15/077 123/509

(Continued)

FOREIGN PATENT DOCUMENTS

JP 256372905-58580 8/1993
JP 11-280579 A 12/1999

(Continued)

OTHER PUBLICATIONS

Japanese Office Action in corresponding Application No. JP2014-183279, dated Aug. 29, 2017.

*Primary Examiner* — Hung Q Nguyen
*Assistant Examiner* — Xiao Mo
(74) *Attorney, Agent, or Firm* — Greenblum & Bernstein, P.L.C.

(57) ABSTRACT

A work vehicle is provided with fuel supply lines that include a first fuel supply line that connects a first fuel tank and a junction. A second fuel supply line connects a second fuel tank and the junction. A common supply line connects the junction and a diesel engine. A fuel pump is provided on the common supply line. A first check valve is installed on the first fuel supply line and opens in accordance with a pressure differential between a pressure in the first fuel tank and a pressure in the junction. A second check valve is installed on the second fuel supply line and opens in accordance with a pressure differential between a pressure in the second fuel tank and a pressure in the junction. A fuel return line returns excess fuel from the diesel engine to the first fuel tank and the second fuel tank.

12 Claims, 11 Drawing Sheets

(56) References Cited

U.S. PATENT DOCUMENTS

| | | | | |
|---|---|---|---|---|
| 2006/0037587 | A1* | 2/2006 | McClure | F02M 33/08 123/509 |
| 2010/0258094 | A1* | 10/2010 | Hull | F02B 51/04 123/536 |
| 2011/0209689 | A1 | 9/2011 | Kuhn | |
| 2011/0297126 | A1* | 12/2011 | Akagi | F02M 37/0029 123/457 |
| 2013/0087124 | A1* | 4/2013 | Kylstrom | F02D 19/0684 123/447 |

FOREIGN PATENT DOCUMENTS

| | | | |
|---|---|---|---|
| JP | 2000-192507 | A | 11/2000 |
| JP | 2007-309137 | A | 11/2007 |
| JP | 2009-137454 | A | 6/2009 |

* cited by examiner

DIESEL WORK VEHICLE WITH DUEL FUEL TANKS

CROSS-REFERENCE TO RELATED APPLICATIONS

The present application claims priority under 35 U.S.C. § 119 of Japanese Application No. 2014-183279, filed on Sep. 9, 2014, the disclosure of which is expressly incorporated by reference herein in its entirety.

BACKGROUND OF THE INVENTION

1. Field of the Invention

The present invention relates to a work vehicle with a built-in diesel engine that is supplied with fuel from a plurality of fuel tanks.

2. Description of Related Art

Japanese Registered Utility Model Publication No. 2563729 discloses a farm tractor. In a fuel tank installation structure on the farm tractor, the upper parts of the right fuel tank and the left fuel tank are coupled via an airflow pipe, while the bottom parts of the right fuel tank and the left fuel tank are coupled via a fuel output pipe. Further, a pump intake pipe branches off from the center of the fuel output pipe (refer to FIG. 1 and FIG. 4). The pump intake pipe is provided with a fuel pump, and the fuel supply pump supplies the engine with fuel. When the engine is a diesel engine, a fuel return line may be provided to return the fuel from the engine to the fuel tank; however, Japanese Registered Utility Model Publication No. 2563729 does not disclose a fuel return line.

When a plurality of fuel tanks are mounted on a vehicle, considering weight balance of the work vehicle, an amount of fuel remaining in each of the fuel tanks should be reduced in the same manner. For instance, the system may be provided with a fuel exchange cock and the like and the fuel tank to be used may be selected each time to ensure that, as much as possible, the fuel remaining in each fuel tank is the same. However, having to operate the fuel exchange cock each time places a burden on a vehicle operator. Thus, a technology is desired that is capable of removing the need for the fuel exchange cock while ensuring that, as much as possible, the amount of fuel remaining in a plurality of fuel tanks is the same.

SUMMARY OF THE INVENTION

A work vehicle with a built-in diesel engine according to the present invention is provided with a fuel supply line that includes a first fuel tank, a second fuel tank, a junction, a first fuel supply line that connects the first fuel tank and the junction, a second fuel supply line that connects the second fuel tank and the junction, and a common supply line that connects the junction and the diesel engine. The work vehicle is also provided with a fuel pump in the common supply line, the fuel pump supplying fuel from the first fuel tank and the second fuel tank to the diesel engine; a first check valve installed on the first fuel supply line to open in accordance with a pressure differential between pressure in the first fuel tank and pressure in the junction; a second check valve installed on the second fuel supply line to open in accordance with a pressure differential between pressure in the second fuel tank and pressure in the junction; and a fuel return line that returns excess fuel from the diesel engine to the first fuel tank and the second fuel tank.

In this configuration, a shared fuel pump takes in fuel from the first fuel tank and the second fuel tank via a check valve to supply the diesel engine with fuel. A check valve is provided on the fuel supply line. Therefore, when supplying the diesel engine with fuel, when there is a pressure difference due to the difference between the amount of fuel remaining in the first fuel tank and the second fuel tank, more fuel is taken in from the fuel tank under the larger pressure. That is, more fuel is taken from the fuel tank storing the larger amount of fuel. Therefore, in the end it is possible to avoid generating a large difference in the amount of fuel stored in the first fuel tank and the second fuel tank, even without providing the conventional kind of fuel exchange cock.

For a diesel engine, a large amount of the fuel supplied by the fuel pump returns to the fuel tank again through the fuel return line. Therefore, the amount of fuel returning from the diesel engine to the first fuel tank and the second fuel tank should be as equal as possible to ensure a large difference is not created between the amount of fuel stored in the first fuel tank and the second fuel tank (remaining fuel). Thus, in another aspect of the present invention, the fuel return line is configured by a common return line connecting the diesel engine and a splitter; a first fuel return line connecting the splitter and the first fuel tank; a second fuel return line connecting the splitter and the second fuel tank; a return port on the first fuel return line formed inside the first fuel tank; and a return port on the second fuel return line formed inside the second fuel tank. The return port on the first fuel return line and the return port on the second fuel return line are placed at the same height (or substantially the same height) in the respective fuel tanks. Given this feature, the splitter creates a branch in the fuel returning from the diesel engine, so that each branch of the fuel returns the first fuel tank and the second fuel tank respectively. At that point, the amount of fuel stored in either of the fuel tanks increases. For example, assuming the return port is closed, the pressure inside the corresponding fuel return line increases. Therefore, the fuel returning from the diesel engine will flow into the other fuel tank, thus preventing only one of the fuel tanks from becoming full. Having both the return ports at substantially the same height in the embodiment means ensuring that the return ports are at a height that prevents only one of the fuel tanks becoming full.

A flow resistance of the fuel in the first fuel return line and the second fuel return line may be made practically the same to ensure that, as much as possible, a proportion of fuel returned from the diesel engine to the first fuel tank and the second fuel tank is the same. For example, it is preferable that a difference in flow resistance between the first and second fuel tanks is from 0% to 20%. In that case a preferred measure would be ensuring that a flow cross-section area and a flow path length of the first fuel return line and the second fuel return line are practically the same. For example, the difference in the flow cross-section area and the flow path length of the first fuel return line and the second fuel return line is preferably from 0% to 20%.

Further, a float valve is preferably provided to control variation in the amount of fuel returning from the diesel engine to the first fuel tank and the second fuel tank. The float valve is provided in the return port on the first fuel return line and in the return port on the second fuel return line, the float valves closing when a fuel level exceeds a fixed level. This configuration introduces a bias in the proportion of return fuel so that even if the fuel level in one of the fuel tanks exceeds the fixed level, the float valve in the corresponding fuel return line closes, and thus prevents any more fuel from entering.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the forms of the present invention may be embodied in practice.

Figure 1:
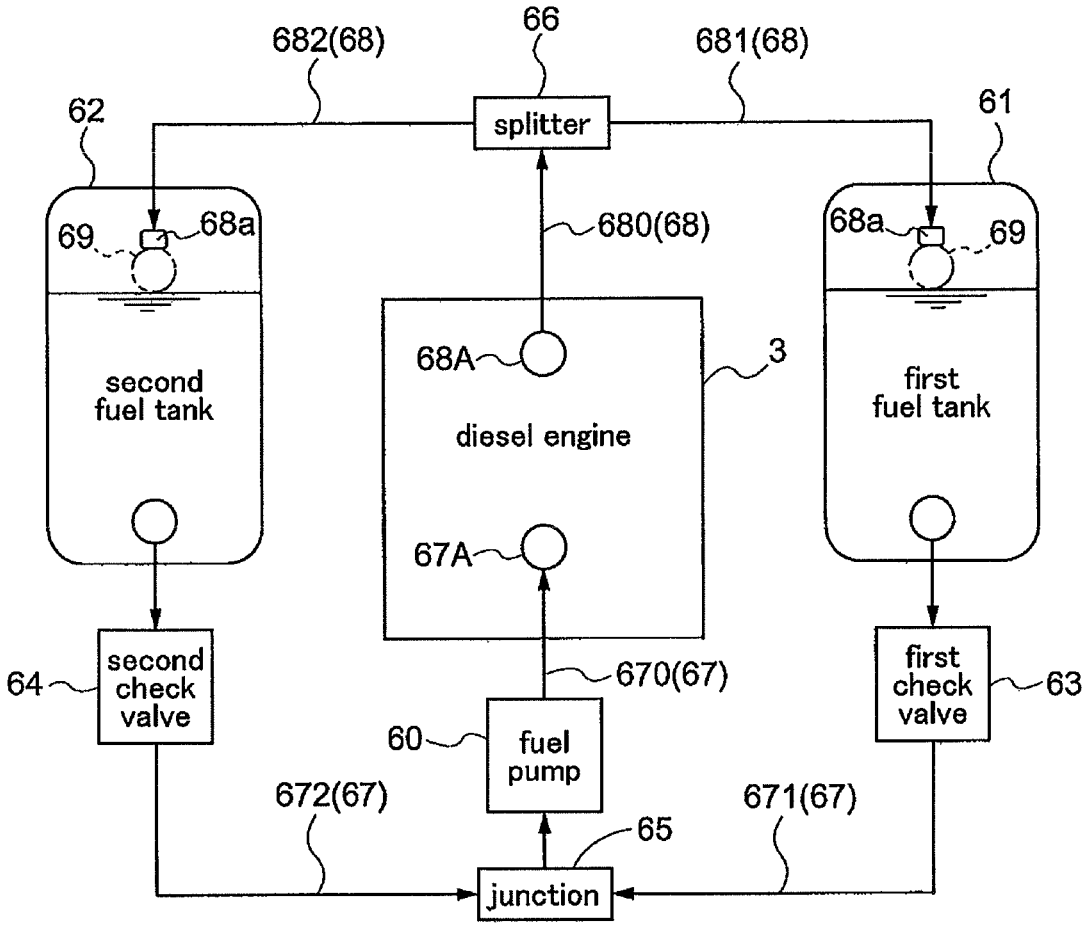
FIG. 1 is a schematic view for explaining the basic principles of fuel supply in the present invention.

Before describing a specific embodiment of a work vehicle, a basic configuration of a fuel supply system, which is one feature of the present invention, is described using FIG. 1. The work vehicle has a built in diesel engine 3. The diesel engine 3 receives fuel from a left and right pair of first and second fuel tanks 61 and 62. In practical terms, the first fuel tank 61 and the second fuel tank 62 have substantially the same form; however, the fuel tanks are not required to be absolutely identical in shape and/or size. The first fuel tank 61, the second fuel tank 62, and a fuel supply port 67A in the diesel engine 3 are connected via a fuel supply line 67, which is generally configured from fuel hoses. The fuel supply line 67 is formed from or constituted by a first fuel supply line 671 connecting the first fuel tank 61 and a junction 65; a second fuel supply line 672 connecting the second fuel tank 62 and the junction 65; and a common supply line 670 connecting the junction 65 and the fuel supply port 67A in the diesel engine 3. A first check valve 63 is installed on the first fuel supply line 671, and a second check valve 64 is installed on the second fuel supply line 672. A fuel pump 60 is installed on the common supply line 670. The first check valve 63 and the second check valve 64 each open in accordance with a pressure differential between the pressure in the connected fuel tank and the pressure in the junction. That is, when driving the fuel pump 60 creates a negative pressure in the junction 65, the first check valve 63 and the second check valve 64 open, and the fuel flows into the common supply line 670 from the first fuel tank 61 and the second fuel tank 62.

When the fuel pump 60 is driven, a suction force of the fuel pump 60 reduces the pressure between the first check valve 63 and the section of the junction 65 connected to the first fuel supply line 671 compared to the pressure between the first check valve 63 and the first fuel tank 61; therefore, the first check valve 63 opens to supply fuel from the first fuel tank 61 to the diesel engine 3. Fuel is supplied from the second fuel tank 62 to the diesel engine 3 in the same manner. However, when a larger amount of fuel is stored in either the first fuel tank 61 or the second fuel tank 62, the pressure increases in the check valve for the fuel tank with the larger amount of fuel, thereby increasing the degree to which the corresponding check valve opens. As a result of this pressure differential, the fuel pump 60 takes in the fuel from primarily the fuel tank having the larger amount of stored fuel. Consequently, this equalizes the amount of fuel stored in the first fuel tank 61 and the second fuel tank 62.

The first fuel tank 61, the second fuel tank 62, and a fuel return port 68A in the diesel engine 3 are connected via the fuel return line 68, which is generally configured from fuel hoses. The fuel return line 68 is formed from or constituted by a common return line 680 connecting the fuel return port 68A in the diesel engine 3 and a splitter 66; a first fuel return line 681 connecting the splitter 66 and a return port 68*a* in the first fuel tank 61; and a second fuel return line 682 connecting the splitter 66 and the return port 68*a* in the second fuel tank 62. Each return port 68*a* is formed at substantially the same height inside the first fuel tank 61 and the second fuel tank 62 respectively. To ensure that the flow resistance of the fuel in the first fuel return line 681 and the second fuel return line 682 are practically the same, the first fuel return line 681 and the second fuel return line 682 have essentially the same flow cross-section area and flow path length. Therefore, for instance, the pressure in the first fuel return line 681 increases when the return fuel is flowing into the first fuel tank 61 and the fuel reaches the return port 68*a* in the first fuel tank 61. Thereby, in the splitter 66 most of the fuel returning from the diesel engine 3 flows toward the second fuel tank 62 to equalize the amount of fuel stored in the first fuel tank 61 and the second fuel tank 62.

Furthermore, the return ports 68*a* on the first fuel return line 681 and the second fuel return line 682 may each be provided with a float valve 69. The float valve 69 closes when the fuel level exceeds a fixed level, and ensures more reliable adjustments to the above-described returning fuel.

Figure 2:
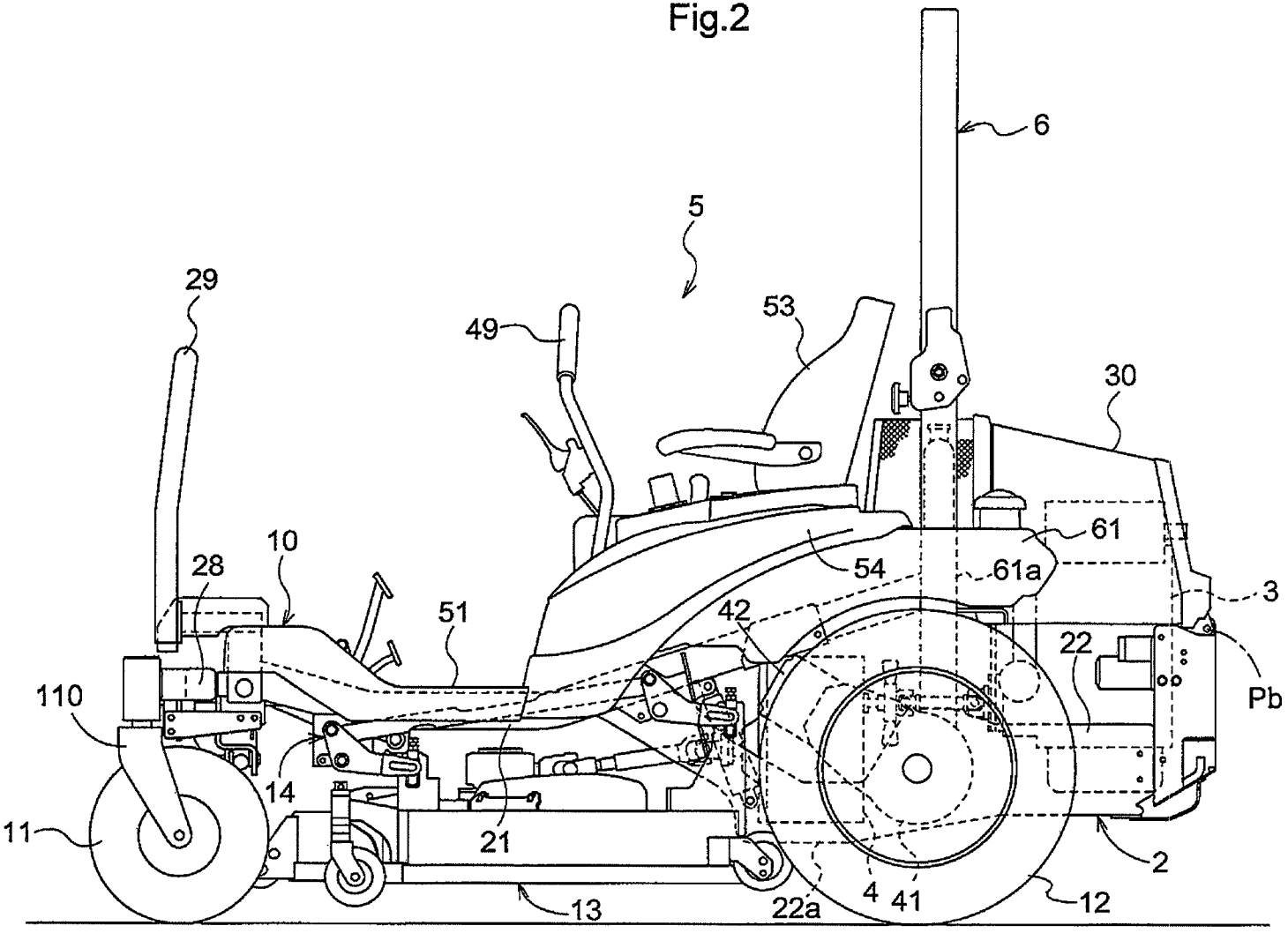
FIG. 2 is a side view of a zero-turn mower, which is a specific embodiment of a work vehicle.
Figure 3:
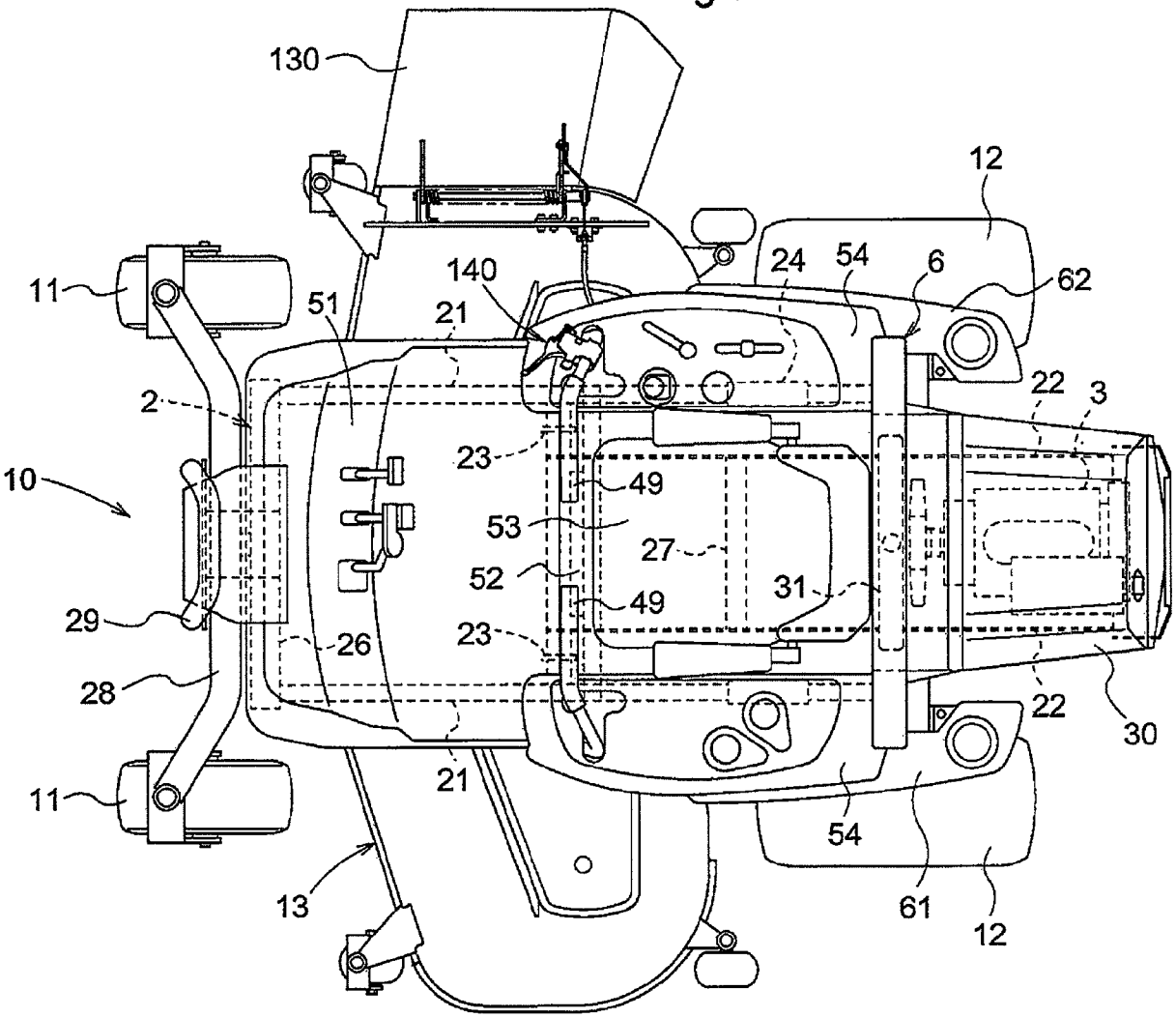
FIG. 3 is a top or plan view of the zero-turn mower.

Next, a specific embodiment of a work vehicle according to the present invention is described with reference to the drawings. The work vehicle is a riding mower with a mower unit 13 installed as work equipment. FIG. 2 is a side view of the riding mower; FIG. 3 is a plan view of the same. The riding mower is called a zero-turn mower. The zero-turn mower is equipped with a vehicle body 10 supported on the ground by a pair of left and right front wheels 11 and a pair of left and right rear wheels 12; the pair of rear wheels are drive wheels which may be rotationally driven independently. The vehicle body 10 possesses a vehicle body frame 2 that acts as a base. The mower unit 13 is suspended from the vehicle body frame 2 between the front and rear wheels 11 and 12 via a link mechanism 14. An operating unit 5 is provided in a front/back direction center region of the vehicle body 10. Thus, a seat support 52 may be formed in the front/back direction center region of the vehicle body 10. A driver seat 53 is provided on an upper surface of the seat support 52. Further, fenders 54 are formed on left and right side surfaces of the seat support 52. Finally, a step 51 is laid or located in front of the driver seat 53. The first fuel tank 61 is arranged underneath the left fender 54 along a peripheral surface of the rear wheel 12; the second fuel tank 62 is arranged underneath the right fender 54 along the peripheral surface of the rear wheel 12.

A rollover protection structure (ROPS) 6 is provided in the rear portion of the operating unit 5. The diesel engine 3 is arranged in the rear end region of the vehicle body 10, and a transmission 4 is arranged in front of the diesel engine 3. The transmission 4 includes a pair of left and right rear-axle transmission units 41. The left and right rear-axle transmission units 41 each have a built-in hydrostatic transmission mechanism (abbreviated to HST 42 below), and are one example of a continuously variable transmission. The HST 42 provided to the left and right rear-axle transmission units 41 may each be operated independently. The HST 42 continuously varies the speed from low to high while the engine output is in normal rotation (forward) or reverse rotation (backward) and transmits the power of the engine to each of the rear wheels 12. Thereby, both the left and the right rear wheels 12 may be driven in a forward direction at the same or substantially the same speed to initiate straight line forward travel, and both the left and the right rear wheels 12 may be driven in a backward direction at the same or substantially the same speed to initiate straight line backwards travel. The vehicle body 10 may be made to turn in an arbitrary direction by ensuring the speed of the left and right rear wheels 12 are different from each other; for example, operating one of the left or the right rear wheel 12 at a low speed near zero and operating the other rear wheel 12 forward or backward at a high speed would cause the vehicle body 10 to make a tight turn. Additionally, driving the left and the right rear wheels 12 in directions opposite from each other would cause the vehicle body 10 to perform a spinning turn about a turning center that is substantially the center portion between the left and right rear wheels 12. Finally, the pair of left and right front wheels 11 are configured by caster wheels, and can change orientation freely about a vertical axis center; thus, the orientation of the pair of left and right front wheels 11 can be corrected depending on the traveling direction set due to how the left and right rear wheels 12 are driven.

Speed changing in the left and right HST 42 is carried out by operating a pair of left and right speed changing levers 49 arranged on both sides of the driver seat 53. When the speed changing levers 49 are held at a front/back direction neutral position, the continuously variable transmission is in a neutral-stop; when the speed changing levers 49 are moved forward or rearward from the neutral position, a forward speed change or reverse speed change are implemented, respectively.

As is clear from FIG. 3, the vehicle body frame 2 is formed from a pair of left and right front frames 21 and a pair of left and right rear frames 22. The left and right front frames 21 are coupled together by a front crossbeam unit 26 configured by a plurality of cross beams. In the same manner, the left and rear right rear frames 22 are coupled together by a rear crossbeam unit configured by a plurality of crossbeams; however, the rear crossbeam unit is not depicted. The diesel engine 3 is installed in the rear end region of the rear frames 22.

The front crossbeam unit 26 is located on the front end of the vehicle body 10 and is provided with a front-wheel support arm 28 that extends along the transverse direction of the vehicle. A reverse U-shaped front guard 29 is provided rising from the center of the front-wheel support arm 28. A front wheel 11 is attached to each end of the front-wheel support arm 28 via a caster bracket 110.

Figure 4:
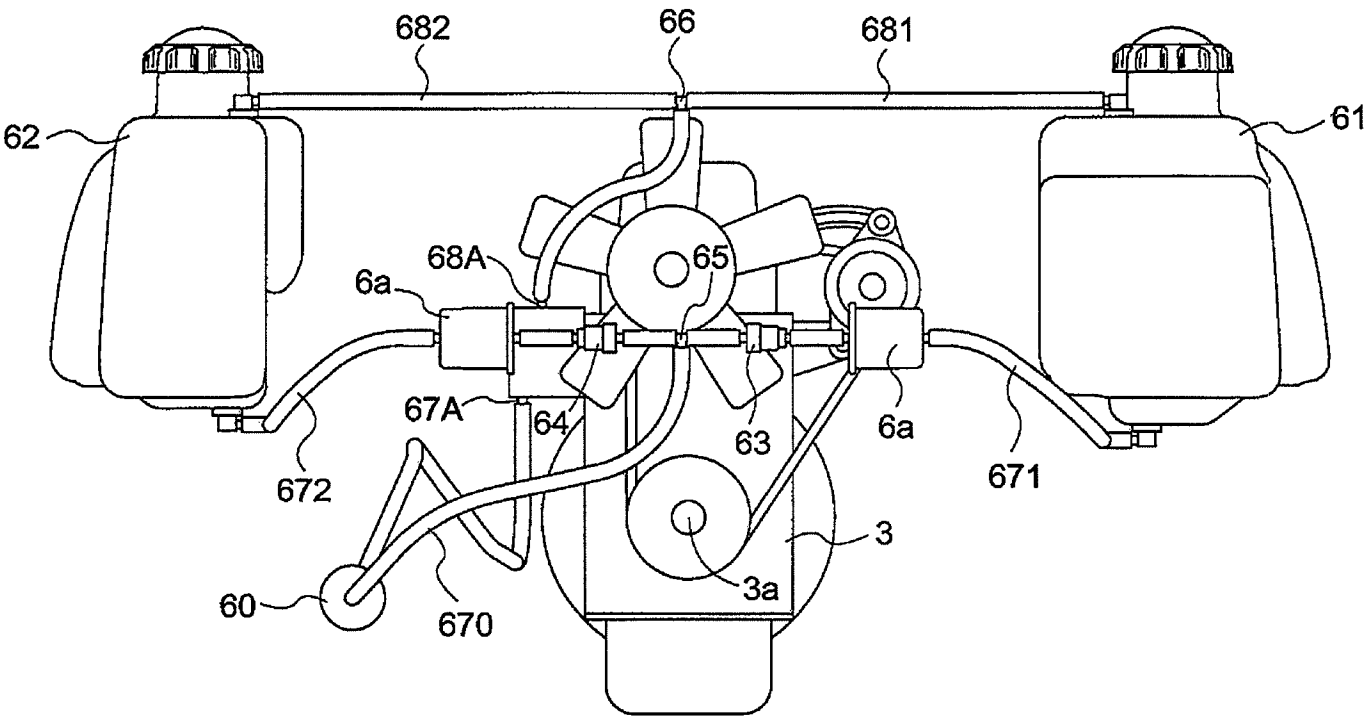
FIG. 4 is a front view illustrating a first fuel tank, a second fuel tank, and an engine.

FIG. 4 illustrates a fuel supply system. Given that this fuel supply system adopts the principles described using FIG. 1, the description of the constituent components illustrated in FIG. 1 is incorporated here in the description of FIG. 4. Here, the bottoms of the first fuel tank 61 and the second fuel tank 62 are located above the crankshaft 3*a* of the diesel engine 3. Furthermore, the first fuel supply line 671 and the second fuel supply line 672 are connected at the bottoms of the first fuel tank 61 and the second fuel tank 62 respectively. Moreover, the first fuel return line 681 and the second fuel return line 682 are connected to the upper surfaces of the first fuel tank 61 and the second fuel tank 62 respectively. Finally, filters 6*a* are placed between the first fuel tank 61 and the first check valve 63, and between the second fuel tank 62 and the second check valve 64, respectively.

Figure 5A:
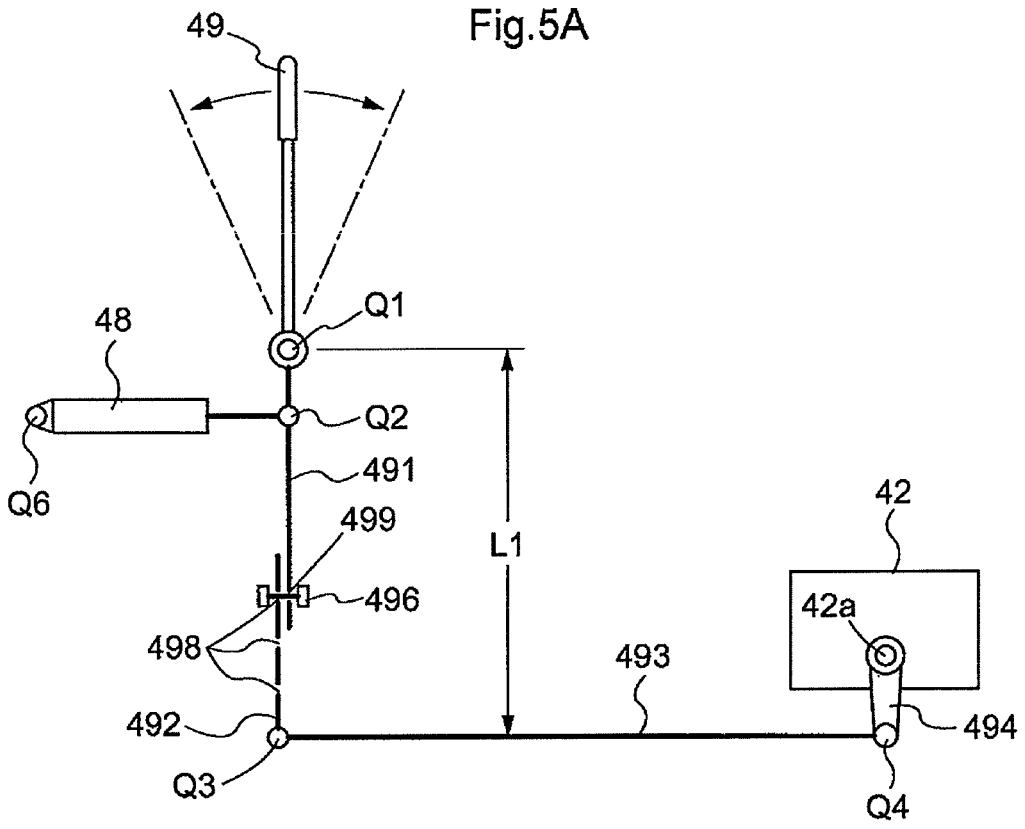
FIG. 5A and FIG. 5B are schematic views illustrating a speed changing system.
Figure 5B:
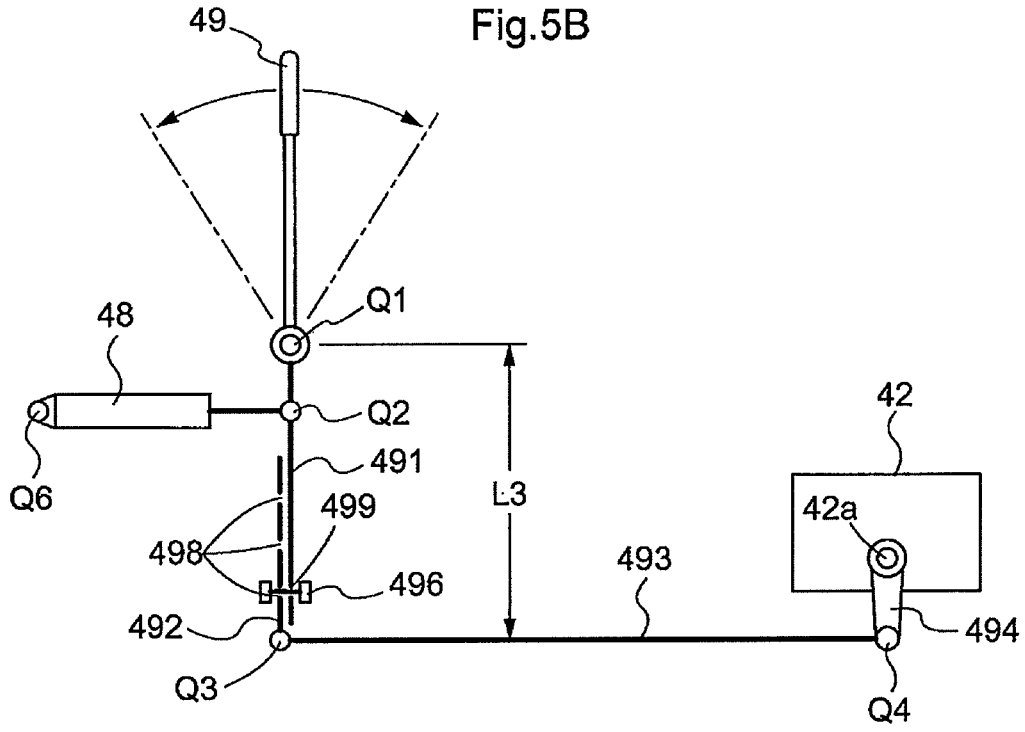

FIG. 5A and FIG. 5B illustrate a speed changing system wherein the HST 42 is operated via the speed changing levers 49. The HST 42 adjusts a swash plate angle in a built-in hydraulic pump or hydraulic motor, or both, to change a rotation speed of an output shaft in forward or reverse rotation. In FIG. 5A and FIG. 5B, a swash plate shaft 42*a* protrudes from an HST housing, and the HST 42 is changed by adjusting the rotation of the swash plate shaft 42*a*. An HST link 494 is secured to the swash plate shaft 42*a* to serve as a swash plate arm.

The speed changing levers 49 are provided to pivot about a first axis center Q1. In the speed changing system, the pivotal displacement of the speed changing levers 49 is transmitted to the swash plate shaft 42*a*, and a link mechanism is built to effect a rotational displacement in the swash plate shaft 42*a*. This link mechanism includes an operation link 490, a transmission link 493, and the HST link 494. A first end of the operation link 490 is supported to pivot about the first axis center Q1 and is coupled to a speed changing lever 49; the first end of the operation link 490 pivots about the first axis center Q1 in accordance with the pivoting of the speed changing lever 49. A second end of the operation link 490 is coupled to a first end of the transmission link 493 at a connection point having a third axis center Q3. The operation link 490 and the transmission link 493 are thereby capable of pivoting relative to each other at the connection point. The second end of the transmission link 493 is coupled to a free end of the HST link 494 at a connection point including a fourth axis center Q4. The transmission link 493 and the HST link 494 are thereby capable of pivoting relative to each other at the connection point. Serving as a swash plate arm, the HST link 494 pivots together with the tilt plate shaft 42*a* about a fifth axis center which is also the shaft center of the tilt plate shaft 42*a*.

In the embodiment, the operation link 490 is coupled to a dampener 48 via a dampener arm 495. A first end of the dampener arm 495 is coupled to a connection point including a second axis center Q2, allowing the dampener arm 495 and the operation link 490 to pivot relative to each other at the connection point. A second end of the dampener arm 495 is coupled to a connection point including a sixth axis center Q6, allowing the dampener arm 495 and dampener 48 to pivot relative to each other about the connection point. Changing the strength of the dampener 48 can thereby change a reactive force of the speed changing lever 49.

The operation link 490 is modularly configured from a first link 491 and a second link 492. Moreover the first and second links 491 and 492 may be coupled via a fully selectable-length coupling mechanism that allows the combined length of the first and second links 491 and 492 to be variable. For example, in FIG. 5A and FIG. 5B the selectable-length coupling mechanism is a coupling pin with three possible connection points. That is, three pin holes 498 are formed at different locations along the length of the second link 492. A single pin hole 499 is formed in the first link 491. The coupling pin 496 inserted into the pin hole 499 in the first link 491 may be inserted into any one of the three pin holes 498 in the second link 492, thereby changing the length of the operation link 490. FIG. 5A illustrates when the coupling pin 496 is inserted into the pin hole 498 in the second link 492 closest to the tip to couple the first link 491 and the second link 492. Here the operation link 490 is a length L1. In contrast, FIG. 5B illustrates when the coupling pin 496 is inserted into the pin hole 498 in the second link 492 closest to the base to couple the first link 491 and the second link 492. Here the operation link 490 is a length L3. Thus, the length L1 is the longest, the length L3 is the shortest, and when the coupling pin 496 is inserted into the middle pin hole 498, the operation link 490 is a length between the length L1 and the length L3.

As described above, changing the length of the operation link 490, i.e., changing the link proportion, varies the responsiveness and operative force of the speed changing levers 49 to the operation of the HST. In other words, the embodiment provides three kinds of operative feel with different kinds of responsiveness and operative power; therefore, the operator may establish a travel operation in accordance with his or her preferences. There may also be two, or four or more levels of operative feel. In addition, a selectable-length coupling mechanism which is implemented by varying the link ratios may adopt various kinds of known methods besides pin coupling, such as a ball latch mechanism, and the like. A configuration may be adopted where the link ratios vary continuously. Moreover, the damping force of the dampener 48 may be made variable to increase the number of variable levels of operating power. The link mechanism is schematically rendered in FIG. 5A and FIG. 5B merely for the purpose of explanation; in reality a more complex link mechanism may be used. For instance, the transmission link 493 may also be configured using a plurality of links.

Figure 6:
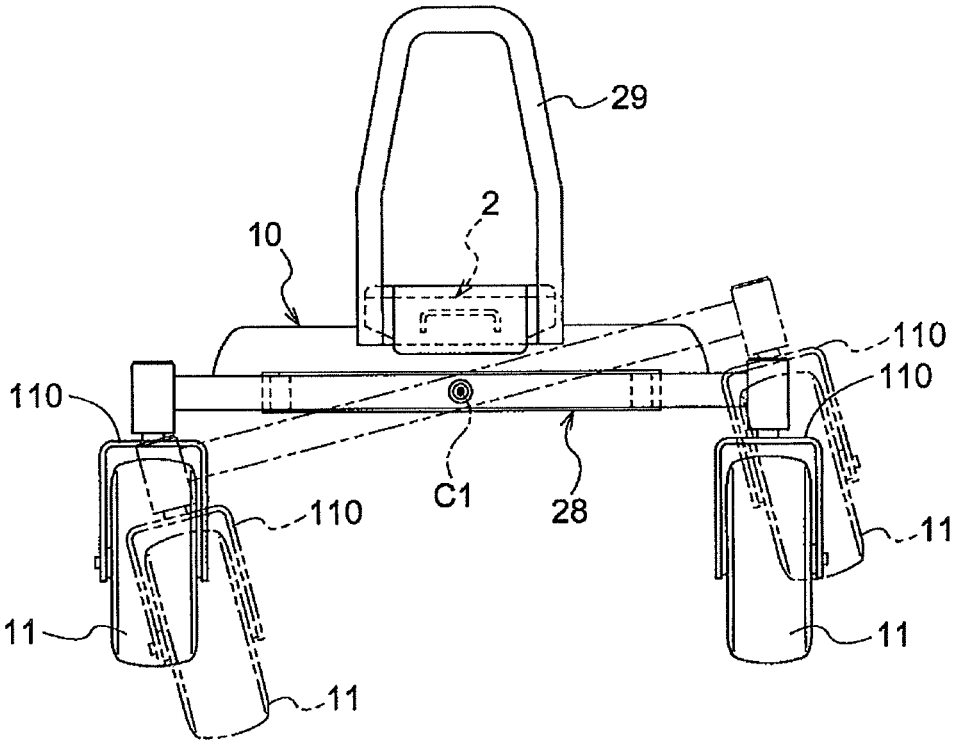
FIG. 6 is a front view illustrating a front wheel support system.

FIG. 6 is a front view illustrating the relationship between the front wheel support arm 28 and the front guard 29. The front-wheel support arm 28 is attached to the vehicle body 10 to pivot (roll) about a swing axis center C1 that extends along the center of the vehicle front/back direction. The front guard 29 rises substantially vertically. Further, as can be ascertained from FIG. 2, the front guard 29 is formed so that the driver seated in the driver seat 53 is under an imaginary plane connecting the upper end of the front guard 29 and the upper end of the ROPS 6 (refer to FIG. 2). In particular, establishing a good height for the front guard 29 allows the driver seated in the driver seat 53 to be under the imaginary plane without needing to increase the height of the ROPS 6. Additionally, the mutual shaping of the front guard 29 and the front-wheel support arm 28 is such that the front-wheel support arm 28 and the front guard 29 do not obstruct each other within the pivoting range of the front-wheel support arm 28.

Figure 7:
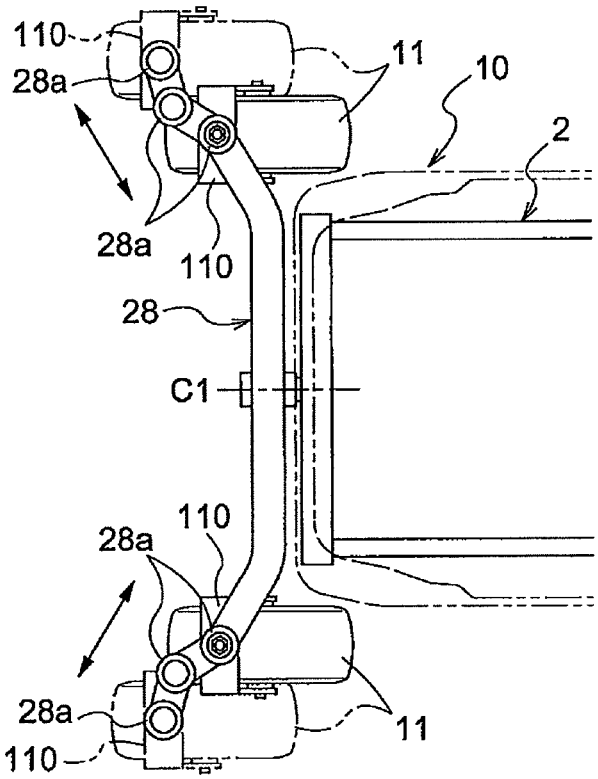
FIG. 7 is a top or plan view illustrating the front wheel support system.
Figure 8:
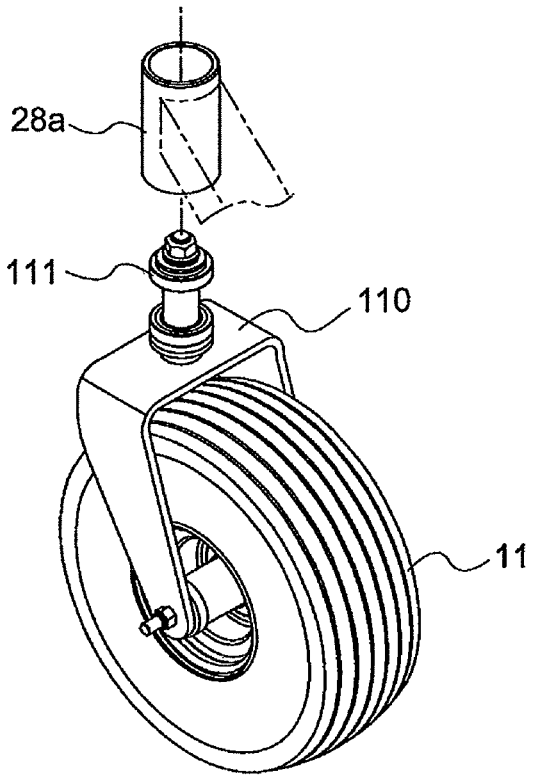
FIG. 8 is a perspective view illustrating a portion of the front wheel support system.

In another embodiment, the location at which the caster brackets 110 supporting the front wheels 11 are attached to the front-wheel support arm 28 varies in the transverse direction of the vehicle body. As illustrated in FIG. 7, three caster bracket mounts 28*a* are formed in both end regions of the front-wheel support arm 28 at different distances from the swing axis center C1 extending along the center of the vehicle front/back direction. As illustrated in FIG. 8, the caster bracket mount 28*a* is simply a cylindrical tube. In this case, a mounting body 111 is formed on the upper surface of the caster bracket 110 to fit in the inner periphery of the cylindrical tube. Thus, selecting one of the three caster bracket mounts 28*a* into which the caster bracket 110 is mounted changes a gap between the left and the right front wheels 11. Moreover, as is clear from FIG. 7, the location of each of the caster bracket mounts 28*a* may differ in not only the transverse direction but also in the front/back direction direction of the vehicle body; thus, the larger the gap between the front wheels 11, the larger the gap between the front wheels 11 and the rear wheels 12. Naturally, there may also be two, or four or more caster bracket mounts 28*a* provided on the front-wheel support arm 28.

Figure 9:
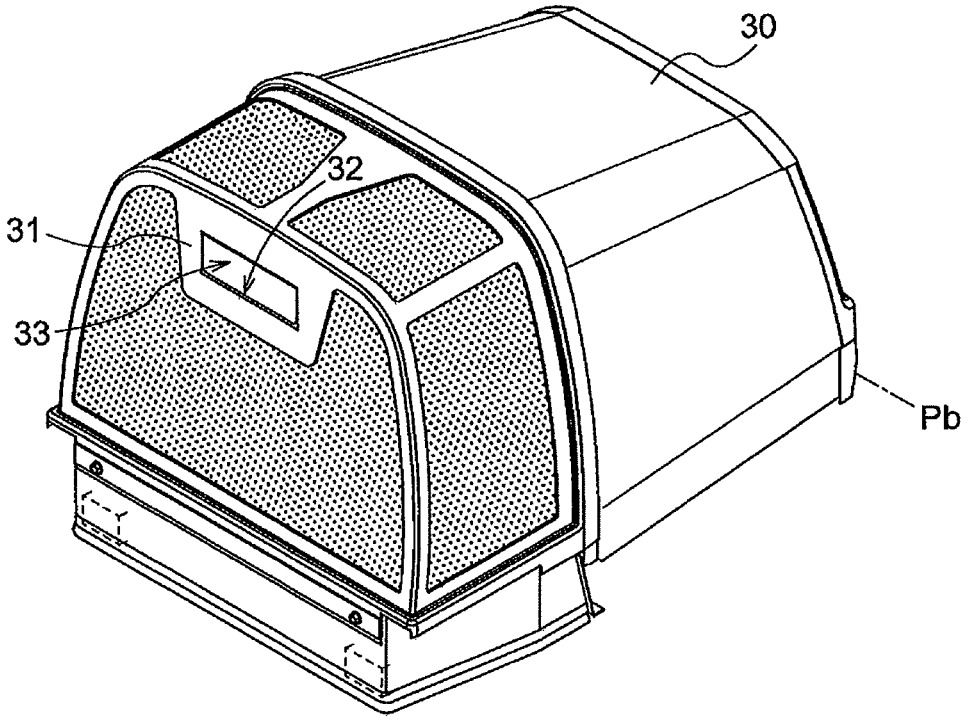
FIG. 9 is a perspective view illustrating a hood.
Figure 10A:
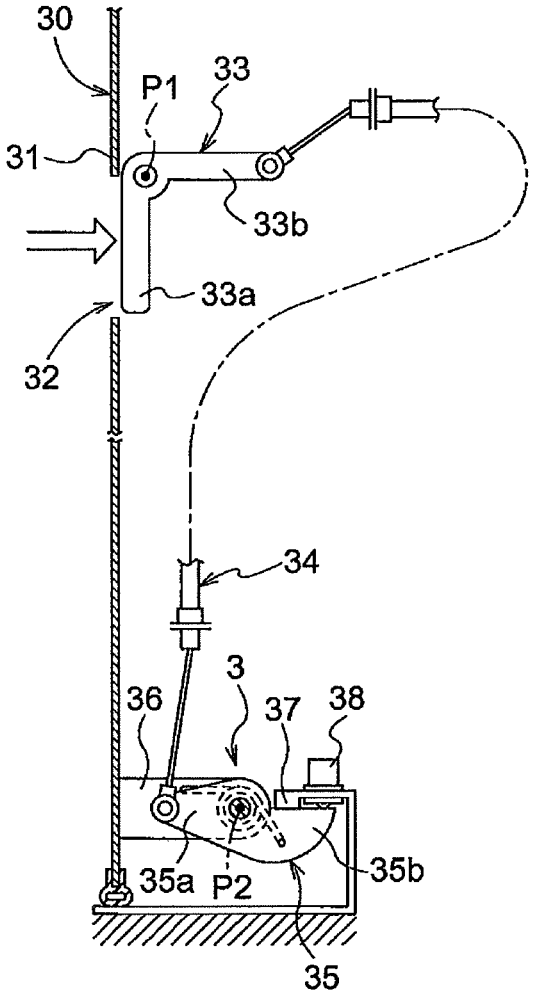
FIG. 10A and FIG. 10B are schematic views illustrating a locking mechanism for the hood.
Figure 10B:
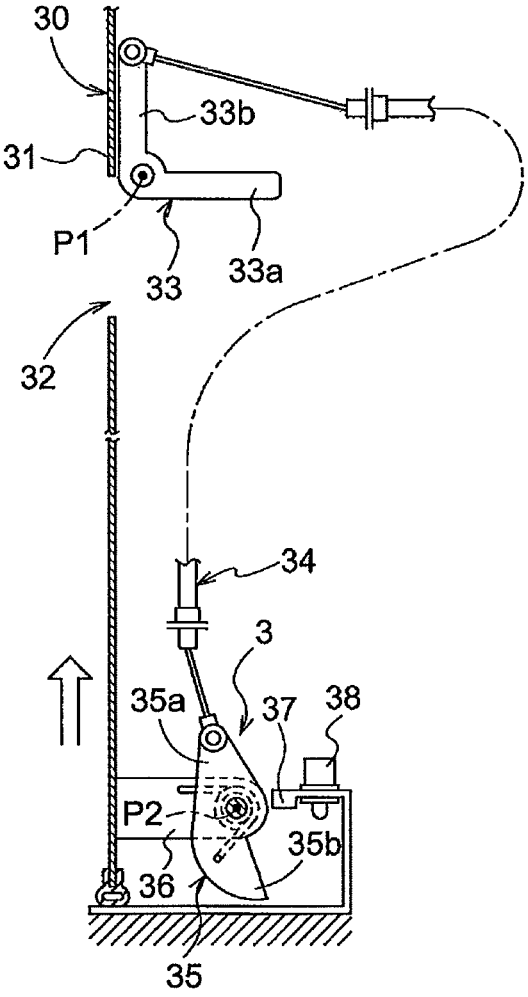

FIG. 9 illustrates the hood 30. The hood 30 covers an engine compartment from above. The engine compartment stores engine accessories such as the diesel engine 3, a radiator, and the like. The lower rearward end of the hood 30 pivots about a swing axis center Pb extending in the transverse direction of the vehicle body between a closed position that closes off the engine compartment, and an open position where the engine compartment is accessible. An opening 32 formed in the upper central region of a front wall 31 of the hood 30 provides an operating part with which the hood 30 is gripped and lifted. As schematically illustrated in FIG. 10A and FIG. 10B, a pivoting body 33 is provided inside the opening 32 to pivot about the swing axis center P1 between a closed position closing off the opening 32 and an open position making the opening 32 accessible. The pivoting body 33 has a first element 33*a* extending in one direction from the swing axis center P1, and a second element 33*b* extending in another direction from the swing axis center P1. The pivoting body 33 is a bent plate where the first element 33*a* and the second element 33*b* are angled at substantially 90 degrees. The first element 33*a* is shaped such that at least a portion thereof is larger than the opening 32; further, gravity biases the first element 33*a* in the closed position to thereby hold the pivoting body 33 in the closed position.

As illustrated in FIG. 10A and FIG. 10B, a hood locking mechanism 39 is mounted to the lower end region of the front wall 31 of the hood 30. The hood locking mechanism 39 includes a bracket 36 secured to the front wall 31, a lock arm 35 supported to pivot about a swing axis center P2 on the bracket 36, and a stopper 37. The lock arm 35 has a first arm portion 35*a* extending in one direction from the swing axis center P2, and a second arm portion 35*b* extending in the other direction from the swing axis center P2. The second arm portion 35*b* serves as a contact portion that comes in contact with the stopper 37. When the lock arm 35 is horizontal as illustrated in FIG. 10A, the second arm portion 35*b* and the stopper 37 are in contact, and therefore prevent the hood 30 from pivoting towards the open position. When the lock arm 35 is vertical as illustrated in FIG. 10B, the second arm portion 35*b* and the stopper 37 are no longer in contact, thereby allowing the hood 30 to pivot towards the open position. The lock arm 35 biases the second arm portion 35*b* and the stopper 37 into contact with each other with a spring.

One end of a cable release unit 34 is coupled to a free end of the second element 33*b* of the pivoting body 33; the other end of the cable release unit 34 is coupled to a free end of the first arm portion 35*a* of the lock arm 35. The cable release unit 34 controls the positional relationship between the pivoting body 33 and the lock arm 35. That is, when the pivoting body 33 is in the closed position, the lock arm 35 is horizontal, locking the hood 30; further, when the pivoting body 33 is in the open position, the lock arm 35 is vertical, releasing the lock on the hood 30.

Given the above described hood structure, to open the hood 30, an operator inserts his or her hand into the opening 32, swings the pivoting body 33 from the closed position to the open position, and uses the first element 33*a* of the pivoting body 33 as a grip to raise the hood 30. At the same time, the lock arm 35 is positioned vertically, releasing the lock and allowing the hood 30 swing to the open position.

The stopper 37 may be provided with a switch 38 that is operated when the lock arm 35 moves to the horizontal position. Moreover, the open or closed state of the hood 30 can be detected on the basis of a switching signal from the switch 38. Accordingly, the vehicle may be configured to control engine stop or engine startup on determining that the hood 30 is open or that the lock is released.

Figure 11:
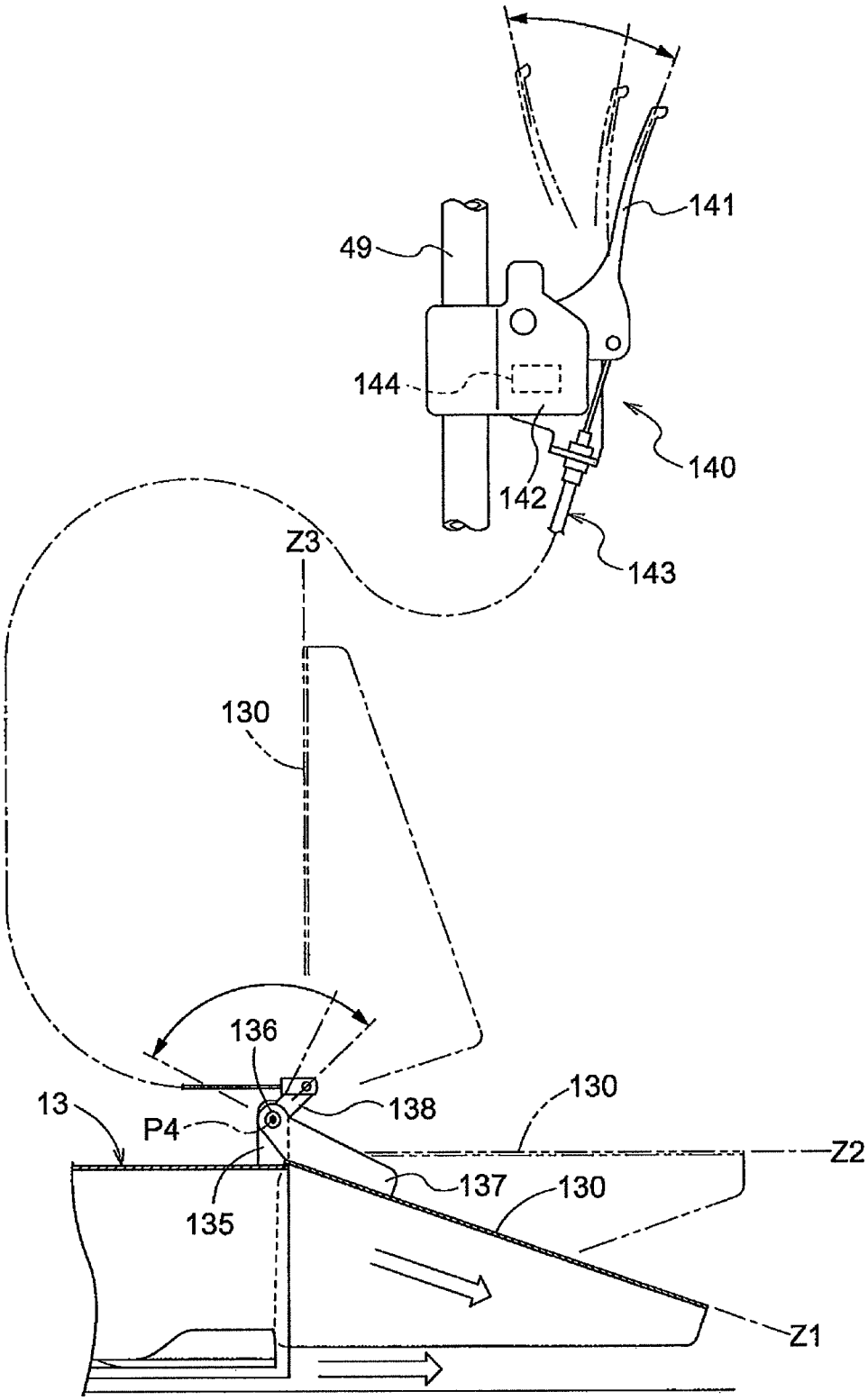
FIG. 11 is a schematic view illustrating an angle changing mechanism for a side discharge cover on a mower unit.

As illustrated in FIG. 3 and FIG. 11, a side discharge cover 130 is provided as a panel covering a side discharge port on the mower unit 13. The side discharge cover 130 is capable of pivoting relative to the mower unit 13 about a swing axis center P4 extending in the front/back direction of the vehicle body. A first bracket 135 is provided on an upper surface of a deck of the mower unit 13, and a second bracket 137 is provided on an upper surface of the side discharge cover 130 to allow the side discharge cover 130 to pivot. The first bracket 135 and the second bracket 137 are coupled via a pivot 136 which creates the swing axis center P4. The side discharge cover 130 may be fixed at a first discharge position (Z1, in FIG. 11) where the upper surface thereof angles downward; a second discharge position (Z2, in FIG. 11) where the upper surface thereof is horizontal; and a storage position (Z3, in FIG. 11) where the side discharge cover 130 is substantially vertical. In the first discharge position, cut grass is discharged at a limited distance, while in the second discharge position the limitation on the distance at which the cut grass can be discharged is removed. In the storage position, the side discharge cover 130 protrudes only slightly toward the sides, allowing the vehicle body 10 to pull out around trees, obstacles, and the like at close proximity.

In the embodiment, the speed changing lever 49 may be provided with a cover operation part 140 that manipulates the pivot position of the side discharge cover 130. The cover operation part 140 is a hand lever; more specifically, a cover operation lever 141 is pivotally supported on a lever bracket 142 that is secured to one of the speed changing levers 49. The cover operation lever 141 is coupled via a cable release unit 143 to an arm 138 provided on the second bracket 137 on the side discharge cover 130. Accordingly, pivoting the speed changing lever 49 can thereby set the side discharge cover 130 in the first discharge position, the second discharge position, or the storage position. The cover operation part 140 may be provided with a position holding mechanism holding a position relative to the speed changing lever 49 to hold the side discharge cover 130 at the respectively set position. Moreover, the cover operation part 140 may be provided with a position detector 144 that detects the pivot position of the speed changing lever 49 that corresponds to the storage position of the side discharge cover 130. The mower unit 13 may enter a no-drive control state when the side discharge cover 130 is detected in the storage position on the basis of a detection signal output from the position detector 144.

Figure 12:
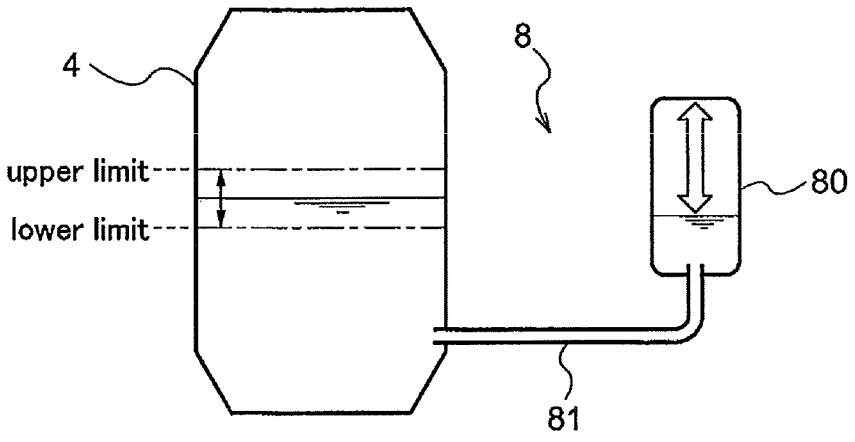
FIG. 12 is a schematic view describing an oil reserve that supplements an oil tank with oil from a reserve tank.

FIG. 12 schematically illustrates an oil-level adjustment mechanism 8 that lowers the risk of the transmission 4 running out of oil. The oil-level adjustment mechanism 8 is equipped with a reserve tank 80 capable of making adjustments to the internal pressure, and a reserve pipe 81 connecting the reserve tank 80 and an oil chamber in the transmission 4. The reserve tank 80 adjusts the internal pressure therein to thereby adjust the oil level of the oil chamber in the transmission 4. The internal pressure of the reserve tank 80 is normally kept high. When excess oil is supplied to the oil chamber in the transmission 4 during this time, the internal pressure of the reserve tank 80 is lowered and the excess oil from the oil chamber is received via the reserve pipe 81 to maintain the oil at an appropriate level in the oil chamber. In contrast, when there is insufficient oil in the oil chamber in the transmission 4, the internal pressure of the reserve tank 80 is raised to supply oil to the oil chamber via the reserve pipe 81 to maintain the oil at an appropriate level in the oil chamber.

Figure 13:
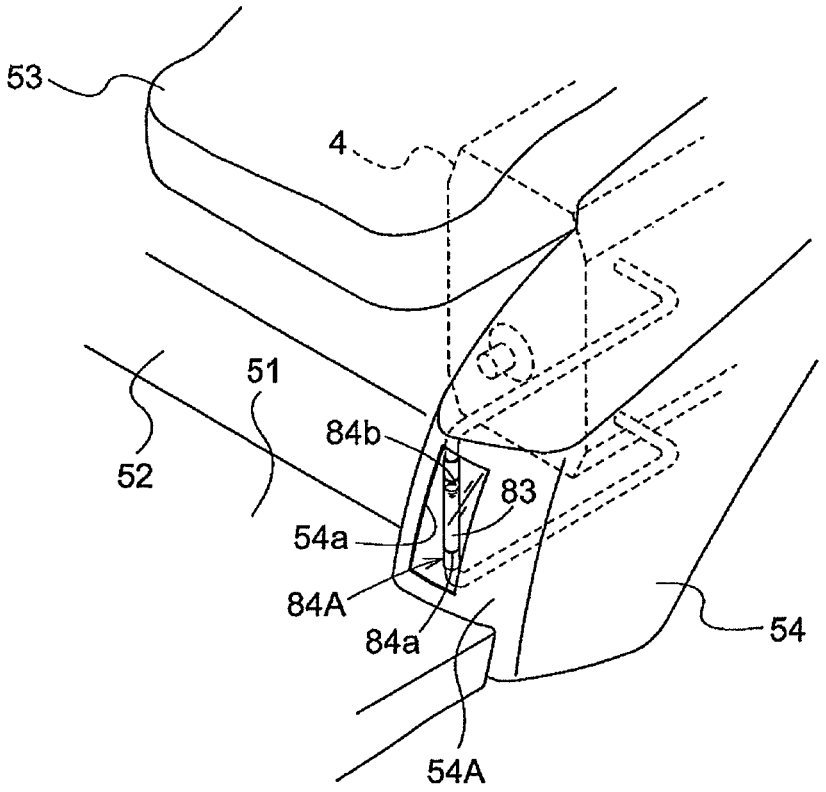
FIG. 13 is a schematic view illustrating an oil gauge that represents an amount of oil within a transmission.

FIG. 13 schematically illustrates a configuration whereby the oil level of the oil chamber in the transmission 4 may be easily monitored. A test pipe 83 runs from the oil chamber in the transmission 4 that is arranged beneath the driver seat 53 to near a front wall 54A of a fender 54 located next to the driver seat 53. A peephole 54*a* is formed in the front wall 54A of the fender 54, and the test pipe 83 extends vertically through the region including the peephole 54*a*. At least the portion of the test pipe 83 running vertically is made of a transparent material, and serves as an oil gauge 84A. A lower limit line 84*a* representing a lower limit of the oil level, and an upper limit line 84*b* representing an upper limit of the oil level are marked on the oil gauge 84A. As is clear from FIG. 13, the peephole 54*a* is located just above a borderline between the step 51 and the front wall 54A of the fender 54. The view of the peephole 54*a* is not obstructed from the side or the front, and thus the oil level in the oil gauge 84A can be easily seen. In FIG. 13 the oil gauge 84A and the peephole 54*a* are provided on the left side of the vehicle body 10; however, these elements may be provided on the right side, or on both sides of the vehicle body 10.

Figure 14:
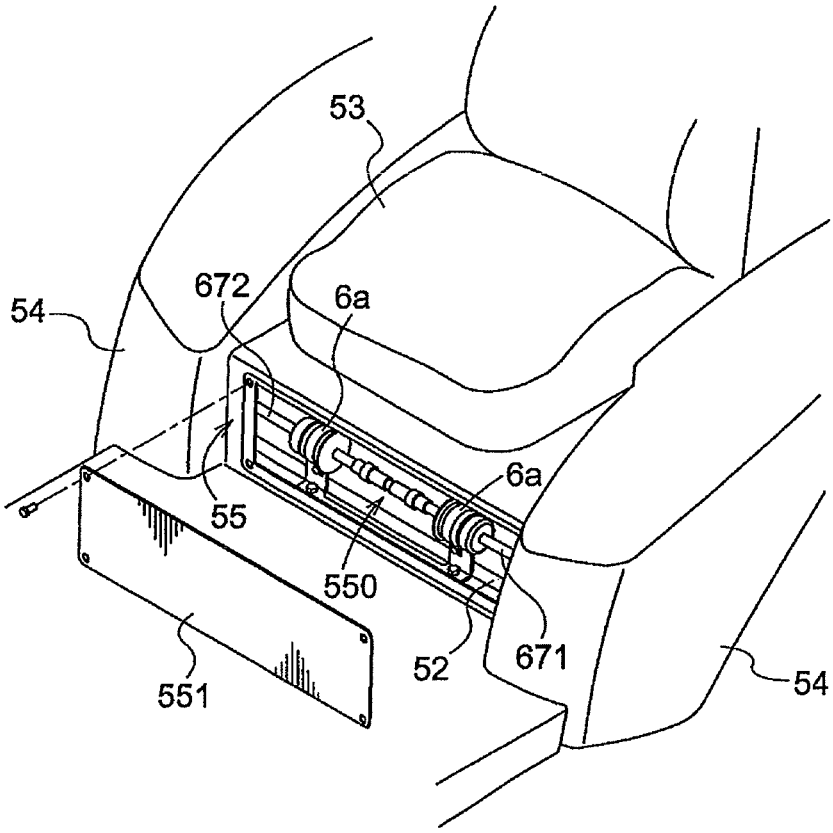
FIG. 14 is a schematic view illustrating an opening for replacing a filter element of a filter installed on a fuel supply line.

FIG. 14 illustrates a structure for maintenance and inspection of a filter (left filter) 6*a* installed on the first fuel supply line 671 of the fuel supply system, and a filter (right filter) 6*a* installed on the second fuel supply line 672. The right and left filters 6*a* are aligned in a horizontal direction in a front region of an interior space of the seat support 52 supporting the driver seat 53. The seat support 52 supporting the driver seat 53 is covered with a panel unit 55, the left fender 54 and the right fender 55. The seat support 52 has an opening 550 that allows access to the front region of the interior space. The panel unit 55 includes a front panel 551 covering the opening 550. The front panel 551 is screwed to the seat support 52 to close the opening 550. When the front panel 551 is removed, the opening 550 becomes open, and thus maintenance and inspection of the right and left filters 6*a*, e.g. operation of replacing a filter element of the filter 6*a*, is facilitated.

Other Embodiments (1) In the above-described embodiments, the diesel engine 3 is provided in the rear section of the vehicle body 10; however, the diesel engine 3 may be provided in the front section of the vehicle body 10. Additionally the transmission 4 may be provided behind the diesel engine 3.

(2) The above-described embodiments adopt a configuration where the mower unit 13 is mid-mounted, i.e., arranged between the front wheels 11 and the rear wheels 12. However, a configuration may be adopted where the mower unit 13 is front-mounted, i.e., arranged in front of the front wheels 11.

(3) In the above-described embodiments, the front wheels 11 are caster wheels; however, the front wheels may be steered wheels that are manipulated via a steering wheel. When the front wheels are steered wheels, a differential mechanism branches the output from the same speed changing device, and the left and right rear wheels 12 receive the output from the speed changing device via the differential mechanism.

(4) In the above-described embodiments, a work vehicle with a built-in mower unit 13 serving as the work equipment, i.e., a riding mower, is provided as an example. For instance, a sprayer, a snow remover, a planter, a harvester, or the like may be mounted instead as the work equipment.

The invention may be adopted in work vehicles provided with a diesel engine, a fuel tank, a transmission, and work equipment.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A work vehicle having a diesel engine, the work vehicle comprising:

a first fuel tank;

a second fuel tank;

fuel supply lines including a first fuel supply line connecting a first fuel tank and a junction, a second fuel supply line connecting a second fuel tank and the junction, and a common supply line connecting the junction and the diesel engine;

a first filter arranged in the first fuel supply path and a second filter arranged in the second fuel supply path;

a seat;

a coverable opening arranged below the seat, through which the first filter and the second filter are accessible;

a fuel pump coupled to the common supply line and supplying the diesel engine with fuel from the first fuel tank and the second fuel tank;

a first check valve installed on the first fuel supply line and opening in accordance with a pressure differential between a pressure in the first fuel tank and a pressure in the junction;

a second check valve installed on the second fuel supply line and opening in accordance with a pressure differential between a pressure in the second fuel tank and a pressure in the junction; and a fuel return line returning excess fuel from the diesel engine to the first fuel tank and the second fuel tank, wherein the fuel return line comprises:

a common return line connecting the diesel engine and a splitter;

a first fuel return line connecting the splitter and the first fuel tank; and a second fuel return line connecting the splitter and the second fuel tank, a first return port for the first fuel tank; and a second return port for the second fuel tank, wherein the first and second return ports are arranged at a same height, and wherein a fuel flow resistance of the entire first fuel return line and the entire second fuel return line are the same, and wherein the first filter and the second filter are arranged at a same height.

2. The work vehicle according to claim 1, wherein the first return port is arranged inside the first fuel tank; and the second return port is arranged inside the second fuel tank.

3. The work vehicle according to claim 1, wherein a flow cross-section area and a flow path length being the same in the first fuel return line and the second fuel return line.

4. The work vehicle according to claim 2, wherein the first and second return ports are each coupled to a float valve that closes when a fuel level exceeds a fixed level.

5. The work vehicle according to claim 1, wherein a bottom of the first fuel tank and a bottom of the second fuel tank are located above a crankshaft in the diesel engine.

6. The work vehicle according to claim 5, wherein the first fuel supply line is connected to the bottom of the first fuel tank, the second fuel supply line is connected to the bottom of the second fuel tank, and the fuel return line is connected to upper portions of the first fuel tank and the second fuel tank.

7. The work vehicle according to claim 1, wherein the first and second check valves are at least one of:

normally closed check valves;

biased to a closed position; and/or open when a pressure on an input side is greater than a pressure on an output side.

8. A work vehicle comprising:

an engine;

a first fuel tank;

a second fuel tank;

a first fuel supply path conveying fuel from a first fuel tank to an input of a fuel pump;

a second fuel supply path conveying fuel from a second fuel tank to the input of the fuel pump;

a common supply line connecting an output of the fuel pump to the engine;

the fuel pump supplying the engine with fuel from the first fuel tank and the second fuel tank;

a first filter arranged in the first fuel supply path and a second filter arranged in the second fuel supply path;

a seat;

a coverable opening arranged below the seat, through which the first filter and the second filter are accessible;

a first check valve disposed in the first fuel supply path;

a second check valve disposed in the second fuel supply path;

a first fuel return line returning excess fuel from the engine to the first fuel tank; and a second fuel return line returning excess fuel from the engine to the second fuel tank and the second fuel tank, a first return port for the first fuel tank; and a second return port for the second fuel tank, wherein the first and second return ports are arranged at a same height, and wherein, when a pressure in the first fuel supply path is greater than a pressure in the second fuel supply path, at least one of occurs:

fuel flows from the first fuel tank to the fuel pump; and/or the first check valve opens and the second check valve remains closed, and wherein, when a pressure in the second fuel supply path is greater than a pressure in the first fuel supply path, at least one of occurs:

fuel flows from the second fuel tank to the fuel pump; and/or the second check valve opens and the first check valve remains closed, wherein a fuel flow resistance of the entire first fuel return line and the entire second fuel return line are the same, and wherein the first filter and the second filter are arranged at a same height.

9. The work vehicle according to claim 8, further comprising a junction comprising:

an output coupled to the input of the fuel pump;

a first input coupled to an output of the first check valve; and a second input coupled to an output of the second check valve.

10. The work vehicle according to claim 8, wherein the engine is a diesel engine.

11. A work vehicle capable of using a diesel engine, the work vehicle comprising:

a first fuel tank;

a second fuel tank;

a first fuel supply path conveying fuel from a first fuel tank to a fuel pump;

a second fuel supply path conveying fuel from a second fuel tank to the fuel pump;

a common supply line connecting an output of the fuel pump to the diesel engine;

the fuel pump supplying the diesel engine with fuel from the first fuel tank and the second fuel tank;

a first check valve disposed in the first fuel supply path between the first fuel tank and the fuel pump;

a second check valve disposed in the second fuel supply path between the second fuel tank and the fuel pump;

a first filter arranged in the first fuel supply path and a second filter arranged in the second fuel supply path;

a seat;

a coverable opening arranged below the seat, through which the first filter and the second filter are accessible;

a first fuel return line returning excess fuel from the diesel engine to the first fuel tank;

a second fuel return line returning excess fuel from the diesel engine to the second fuel tank and the second fuel tank, a first return port for the first fuel tank; and a second return port for the second fuel tank, wherein the first and second return ports are arranged at a same height, and wherein, when the first fuel tank contains more fuel than the second fuel tank, at least one of occurs:

fuel can flow from the first fuel tank to the fuel pump; and/or the first check valve opens and the second check valve remains closed, wherein, when the second fuel tank contains more fuel than the first fuel tank, at least one of occurs:

fuel can flow from the second fuel tank to the fuel pump; and/or the second check valve opens and the first check valve remains closed, and wherein a fuel flow resistance of the entire first fuel return line and the entire second fuel return line are the same, and wherein the first filter and the second filter are arranged at a same height.

12. The work vehicle according to claim 11, further comprising a junction comprising:

an output coupled to an input of the fuel pump;

a first input coupled to an output of the first check valve; and a second input coupled to an output of the second check valve.

* * * * *